United States Patent [19]

Albulescu et al.

[11] Patent Number: 4,696,679

[45] Date of Patent: Sep. 29, 1987

[54] METHOD FOR CLEANING GAS PRODUCED FROM SOLID CARBONACEOUS MATERIAL IN A TWO-STAGE GAS PRODUCER

[75] Inventors: Marilena Albulescu, Essex Fells; Joseph F. McMahon, Clinton, both of N.J.

[73] Assignee: Foster Wheeler USA Corporation, Livingston, N.J.

[21] Appl. No.: 790,675

[22] Filed: Oct. 23, 1985

[51] Int. Cl.[4] ..... C10K 1/04

[52] U.S. Cl. ..... 48/203; 48/197 R; 55/11

[58] Field of Search ..... 48/203, 197 R; 55/9, 55/11; 48/206

[56] References Cited

U.S. PATENT DOCUMENTS

| | | | |
|---|---|---|---|
| 1,571,877 | 5/1920 | McElroy . | |
| 1,592,467 | 7/1926 | Rosenthal . | |
| 3,454,382 | 7/1969 | Hamilton . | |
| 3,818,869 | 6/1974 | Blaskowski | 48/206 |
| 3,998,608 | 12/1976 | Livemore . | |
| 4,375,982 | 3/1983 | Chitil | 55/11 |

*Primary Examiner*—Peter Kratz

*Attorney, Agent, or Firm*—Marvin A. Naigur; Robert D. Bajefsky

[57] ABSTRACT

The present invention cleans gas produced from solid carbonaceous materials in a two stage gas producer. Second stage gas from the gas producer is passed through a first precipitator to remove oil mist and particulates from the second stage gas. First stage gas from the gas producer is passed through a cyclone to remove particulates from the first stage gas. The first stage gas from the cyclone is cooled and then mixed with the second stage gas from the first precipitator. The temperature of the gas mixture is maintained at least at the temperature of the second stage gas. The gas mixture is cooled to a temperature in the range of about 25° F. to about 125° F. above the water dew point of the gas mixture. The cooled gas mixture is subsequently passed through a second precipitator to remove oil mist and particulates from the gas mixture and to yield an industrial usable gas.

21 Claims, 2 Drawing Figures

METHOD FOR CLEANING GAS PRODUCED FROM SOLID CARBONACEOUS MATERIAL IN A TWO-STAGE GAS PRODUCER

BACKGROUND OF THE INVENTION

The present invention relates generally to the production of industrial usable gas in a two-stage gas producer and, more particularly, to a method for cleaning gas produced from solid carbonaceous material in a two-stage gas producer to provide a clean industrial usable gas.

In a two-stage gas producer process, second stage gas, also known as top gas, and first stage gas, also known as bottom gas, are produced. Although it is highly desirable to collect and use the first and second stage gases from the gas producer, the collection must be performed in a manner that not only yields a clean industrial usable gas, but also does it in an environmentally and economically sound manner.

The second stage gas contains a mist of small particle size oil droplets and solid particulates, primarily coal fines that are either introduced with the coal feed or made in the gas producer. The first stage gas does not contain oil mist, but it does contain finely divided solid particulates. The particulates are produced in the lower section of the gas producer from the break-up of char caused by the motion of the solids. Therefore, the oil mist and particulates should be removed from the first and second stage gases to produce a clean industrial usable gas.

Various methods have been attempted to remove oil mist and solid particulates from the gases produced by a two stage gas producer. In a hot raw gas technique, the first and second stage gases are passed through separate cyclones to remove oil mist and particulates. After the cyclone treatments, the two gas streams are combined to produce a gas product. This method, however, inherently has a low efficiency for removal of particles having diameters less than 50 microns. As a result, only a part of the oil mist and particulate contamination are removed from the gas product and, hence, the resulting gas is not a clean industrial usable gas.

In a treatment known as hot detarred gas, the second stage gas is passed through an electrostatic precipitator to remove oil mist and particulates. The first stage gas is separately passed through a cyclone to remove particulates. The resulting gas streams are then combined to produce a gas product. Unfortunately, the combined gas still contains significant levels of particulate contamination because of the low efficiency of the cyclone for removal of particulates from the first stage gas. This particulate contamination renders the resulting gas unacceptable for industrial uses that require a clean gas.

In another method, known as the cold clean gas method, the second stage gas is passed through an electrostatic precipitator, while the first stage gas is separately passed through a cyclone and a heat exchanger to reduce the temperature of the first stage gas to about 250° F. The first stage gas is then mixed with the second stage gas, and the gas mixture is subsequently scrubbed with an aqueous liquor in an indirectly cooled scrubbing tower in which the temperature of the gas mixture is reduced to about 100° F. The gas from the scrubbing tower passes through an electrostatic precipitator to yield a gas product.

A key disadvantage of this method, however, is that the aqueous liquor produced in the scrubbing tower contains dissolved organic compounds, such as phenols and pyridines, as well as ammonia and hydrogen sulfide. This contaminated liquor must be either treated extensively before it is discharged from the gas producer facility or incinerated to avoid an adverse impact on the environment. Additionally, in the cold clean gas treatment method, substantial amounts of the heat of the first and second stage gases are lost because of the necessity of cooling the gas mixture to a relatively low temperature to achieve effective scrubbing with the aqueous liquor in the scrubbing tower. As a result, the overall efficiency and economy of the process is substantially reduced.

In summary, all of the previous gas cleaning techniques have significant disadvantages that make them unacceptable for widespread industrial use. None of the previous cleaning techniques provides a clean industrial usable gas, while also satisfying the requisite environmental and economic constraints.

SUMMARY OF THE INVENTION

It is therefore a goal of the present invention to produce a clean gas from solid carbonaceous material in a two stage producer so that the clean gas has various industrial uses.

It is also a goal of the present invention to provide this clean usable gas in an environmentally and economically sound manner.

Additional goals and advantages of the present invention will be set forth in part in the description that follows, and in part will be taught by the description, or may be learned by practice of the invention. The goals and advantages of the invention may be realized and obtained by means of instrumentalities and combinations particularly pointed out in the appended claims.

To achieve these goals and in accordance with the purpose of the invention, the present invention provides a method for cleaning gas produced from solid carbonaceous material in a two stage gas producer consisting essentially of the steps of: (a) passing second stage gas from the two stage gas producer through a first precipitator means to remove oil mist and particulates from the second stage gas; (b) passing first stage gas from the two stage gas producer through a cyclone means to remove particulates from the first stage gas; (c) cooling the first stage gas from the cyclone means; (d) mixing the cooled first stage gas and the second stage gas from the first precipitator means, while maintaining the temperature of the gas mixture at least at the temperature of the second stage gas; (e) cooling the gas mixture to a temperature in the range of about 25° F. to about 125° F. above the water dew point of the gas mixture; and (f) passing the cooled gas mixture through a second precipitator means to remove oil mist and particulates from the gas mixture and yield an industrial usable gas.

The present invention overcomes the various problems associated with previous gas cleaning techniques, and achieves the various goals of the invention. Particularly, the present invention provides a clean industrial usable gas in an economically and environmentally sound manner. The gas mixture produced by the present method is relatively free from oil mist and particulates and, therefore, can be used in industrial situations that require a clean fuel gas.

More particularly, the present method achieves a high removal of oil mist and particulates from the gas without the production of an aqueous condensate, such as the condensate formed in the cold clean gas treatment, that requires extensive treatment and disposal. By eliminating the need for the scrubbing tower and associated equipment, the present method markedly reduces the cost of the gas producing facility compared to, inter alia, the cold clean gas treatment. It is believed, without being bound by theory, that by cooling the gas mixture before passing it through the second precipitator means, the removal of the particulates from the gas mixture is significantly enhanced.

Furthermore, the present invention maintains a higher thermal efficiency in comparison to previous techniques. The product gas made in accordance with the present invention is typically delivered for use at a temperature of about 250° F. or higher. The sensible heat of the gas above an ambient temperature of about 80° F. represents energy recovered from the coal that is not available in previous techniques, such as the cold clean gas method that lowers the temperature of the delivered gas mixture to approximately 100° F.

The foregoing and other goals, features, and advantages of the present invention will be made more apparent from the following description of the preferred embodiments.

BRIEF DESCRIPTION OF THE DRAWINGS

The accompanying drawings, which are incorporated in and constitute a part of the specification, illustrate various embodiments of the invention and, together with a description, serve to explain the principles of the invention.

DETAILED DESCRIPTION OF THE PREFERRED EMBODIMENT

The present invention provides a method for cleaning gas produced from solid carbonaceous materials in a two stage gas producer. In accordance with the present invention, a second stage gas from the two stage gas producer is passed through a first precipitator means to remove oil mist and particulates from the second stage gas. A first stage gas from the two stage gas producer is separately passed through a cyclone means to remove particulates from the first stage gas. The first stage gas from the cyclone means is cooled and then mixed with the second stage gas from the first precipitator means. The temperature of the gas mixture is maintained at least at the temperature of the second stage gas. The gas mixture is then cooled to a temperature in the range of about 25° F. to about 125° F. above the water dew point of the mixture. The cooled gas mixture is subsequently passed through a second precipitator means to remove oil mist and particulates from the gas mixture and yield an industrial usable gas.

Figure 1:
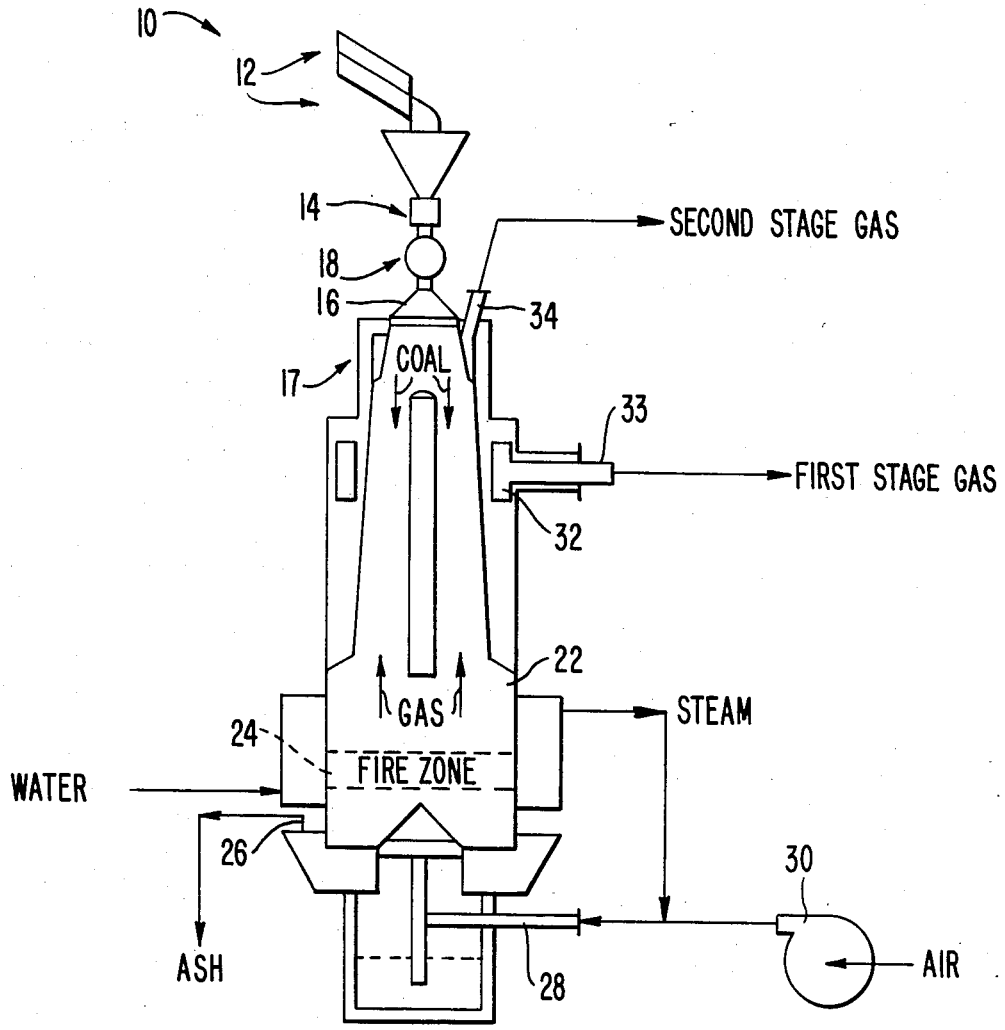
FIG. 1 is a schematic view of a two stage gas producer used in the present invention.

Reference will now be made in detail to the embodiments of the invention that are illustrated in the accompanying drawings. A typical two stage gas producer 10 is shown in FIG. 1. Carbonaceous material, such as coal having a typical size of 2.5 inches by 0.75 inches, is conveyed by an elevation means, such as a bucket elevator, to a polishing screen 12 and a weigh feeder 14. After the screening and weighing of the coal, the coal enters the top portion 16 of the upper section 17 of the gas producer 10 through a lock hopper feed system 18. The coal passes down through the upper section 17 of the gas producer 10 countercurrently to the hot gases rising from the bottom section 22 of the gas producer 10. In the upper section 17 of the gas producer 10, the coal is dried and then devolatilized to produce hydrocarbon vapors and char.

The temperature of the rising gas in the gas producer 10 decreases in the upper section 17 to about 250° F. as heat is transferred to the descending coal from the rising gas. Higher boiling hydrocarbon vapors condense during this gas cooling to form a mist of small particle size oil droplets in the gas. This mist of oil droplets leaves the top portion 16 of the gas producer 10 as part of the second stage gas.

Char resulting from coal pyrolysis passes downwardly through the bottom section 22 of the gas producer 10. In the bottom section 22, the char is partially gasified by reaction with water vapor and carbon dioxide contained in the rising hot gases. The remaining char reaches a fire zone 24 located immediately above an ash grate 26. Steam, conveyed by an air blower 30, is added to the fire zone 24 through a steam inlet 28 to control the temperature of the fire zone 24 to avoid excessive ash fusion.

A portion of the gas leaving the bottom portion 22 of the gas producer 10 flows through a collection pipe 32 and is withdrawn from the gas producer 10 through conduit 33 as first stage gas. The remainder of the gas in the gas producer 10 rises upwardly through the upper section 17 of the gas producer 10. As noted, this rising gas supplies the heat required to dry and devolatilize the coal. The gas in the top portion 16 of the upper section 17 of the gas producer 10 is withdrawn from the gas producer 10 through a conduit 34 and it is known as second stage gas.

Consequently, raw gas from the two stage gas producer 10 consists of first stage gas and second stage gas. The second stage gas is composed mainly of water vapor and various light and heavy hydrocarbons that result from the coal drying and devolatilization. Additionally, hydrogen, carbon monoxide, and carbon dioxide, which result from the gasification and partial combustion of the char, also are present in the second stage gas. Typical second stage gas that is produced from bituminous coal in a two stage gas producer has the following composition:

| Component | Mole Percent (%) |
|---|---|
| $H_2$ | 27 |
| CO | 18 |
| $CO_2$ | 4 |
| $N_2$ | 32 |
| $H_2S$ | 0.4 |
| $H_2O$ | 14 |
| $CH_4$ | 4 |
| oil vapor | 0.6 |
| | 100 |

The second stage gas usually contains oil mist in a concentration of about 15 to 20 grains per standard cubic foot of second stage gas (gr/SCF), depending upon the type of coal burnt in the two stage gas producer. The second stage gas also contains solid particulates, primarily coal fines either introduced with the coal feed or made in the producer. The particulate concentration in the second stage gas varies up to about 1.0 gr/SCF of second stage gas, depending on the type of coal fines present in the two stage gas producer. Of course, other particulate concentrations can be present depending upon the solid carbonaceous material used in the process.

The hydrocarbon component of the second stage gas contains various water soluble organic compounds, such as phenols and pyridines, in concentrations up to several percent of the hydrocarbon content. The cooling of the second stage gas to a temperature lower than the water dew point produces an unwanted aqueous condensate containing these water soluble compounds and, thus, poses various environmental and economic problems.

The first stage gas produced from coal in a two stage gas producer typically does not contain oil mist, but it does contain finely divided solid particulates in concentrations usually up to 5 gr/SCF of first stage gas. The breakup of char from the motion of solids produces these coal fines in the lower section of the two stage gas producer. A typical composition of first stage gas produced from bituminous coal is as follows:

| Component | Mole Percent |
|---|---|
| $H_2$ | 14 |
| CO | 29 |
| $CO_2$ | 6 |
| $N_2$ | 48 |
| $H_2S$ | trace |
| $H_2O$ | 3 |
| $CH_4$ | 0 |
| oil vapor | 0 |
| | 100 |

In accordance with the present invention, the second stage gas from the two stage gas producer is passed through the first precipitator means to remove oil mist and particulates from the second stage gas. As embodied herein and shown in FIGS. 1 and 2, the second stage gas is removed from the top portion 16 of the two stage gas producer 10 through a conduit 34 and is passed through a first precipitator means, such as a first precipitator 38, to remove oil mist and particulates from the second stage gas. The second stage gas is preferably at a temperature in the range of about 200° F. to about 400° F. and, most preferably, in the range of about 250° F. to about 350° F. A suitable precipitator is an oil-washed, tubular electrostatic precipitator sold by the Belco Corporation. The temperature of the second stage gas is maintained within the preferred temperature range by varying the flow rate of the first stage gas. A suitable means for varying this flow rate is a damper valve in conduit 33.

Figure 2:
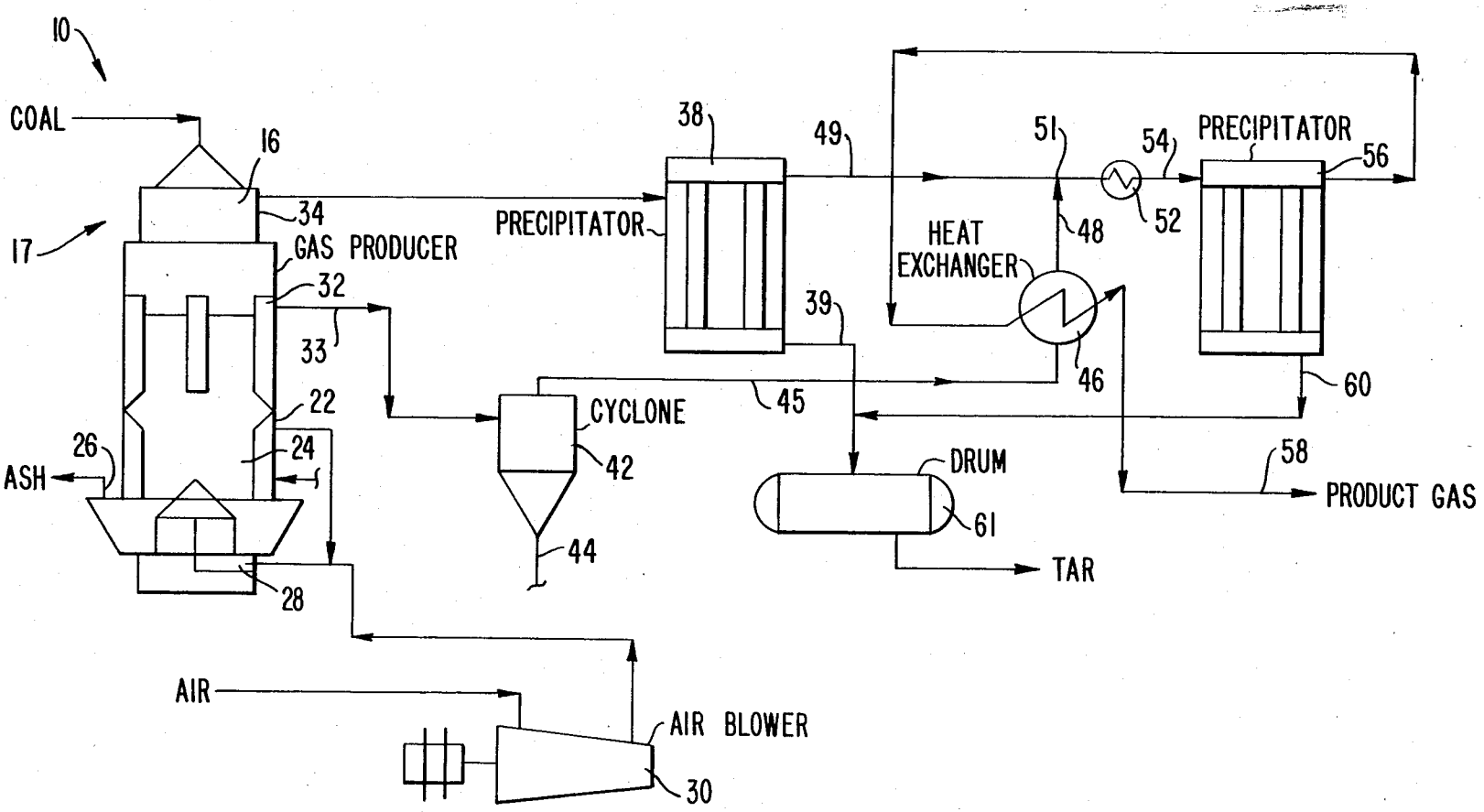
FIG. 2 is a schematic diagram of the method of the present invention.

In accordance with the present invention, the first stage gas from the two stage gas producer is passed through the cyclone means to remove particulates from the first stage gas. As shown in FIGS. 1 and 2, the first stage gas is removed from the bottom portion 22 of the two stage gas producer 10 through the collector pipe 32 and the conduit 33 and is passed through a cyclone means, such as a cyclone 42, to remove particulates from the first stage gas. The solid particulates are removed from the cyclone 42 through a conduit 44. The first stage gas is preferably at a temperature in the range of about 1000° F. to about 1400° F. and most preferably, in the range of about 1150° F. to about 1200° F. Suitable cyclones are the ones sold by Environmental Elements Corporation.

In accordance with the present invention, the first stage gas from the cyclone means is cooled. As shown in FIG. 2, after the first stage gas passes through the cyclone 42, the first stage gas is cooled by feeding the first stage gas through a conduit 45 to a cooling means, such as a heat exchanger 46, to cool the gas. In one embodiment of the invention, heat exchanger 46 is a steam generator in which steam is produced from the heat removed in cooling the first stage gas. The steam produced is an industrially useful energy source that improves the efficiency and economy of the present invention. The temperature to which the first stage is cooled is selected and maintained so that the temperature of the subsequent mixture of the first and second stage gases is not lower than the temperature of the second stage gas passing from the first precipitator 38 prior to mixture with the first stage gas. Preferably, the subsequent mixture of the first and second stage gases has a temperature immediately after mixture within the range of about 200° F. to about 400° F. A suitable heat exchanger is one designated as TEMA (Tubular Heat Exchanger Manufacturers Association) Type AET.

In a second embodiment of the present invention, heat exchanger 46 is a gas to gas heat exchanger in which first stage gas is cooled by reheating the gas passing from precipitator 56. The reheated gas, at a temperature of 400° F. or higher, is an industrially useful clean gas of increased sensible heat content which improves the efficieny and economy of the present invention. The temperature to which the first stage gas is cooled is selected and maintained so that the temperature of the subsequent mixture of the first and second stage gases is not lower than the temperature of the second stage gas passing from the first precipitator 38 prior to mixture with the first stage gas. Preferably, the subsequent mixture of the first and second stage gases has temperature immediately after mixture within the range of about 200° F. to about 400° F. A suitable heat exchanger is one designated as TEMA (Tubular Heat Exchanger Manufacturers Association) Type AET.

In accordance with the present invention, the cooled first stage gas and the second stage gas from the precipitator means are mixed together and the temperature of the gas mixture is at least the temperature of the second stage gas. As embodied in FIG. 2, the first stage gas is fed by a conduit 48 from the heat exchanger 46 and is mixed in a mixer 51 with the second stage gas in a conduit 49 from the first precipitator 38.

In accordance with the invention, after the first and second stage gases are mixed together, the mixture is cooled to a temperature in the range of about 25° F. to about 125° F. above the water dew point of the gas mixture. As embodied in FIG. 2, the mixture of the first and second stage gases is preferably fed through a heat exchanger 52 to cool the gas mixture to a temperature in the range of about 25° to about 125° F. above the water dew point of the gas mixture. A suitable heat exchanger is one designated as TEMA (Tubular Heat Exchanger Manufacturers Association) Type AET.

As used herein, the term water dew point refers to the temperatures at which the gas mixture is saturated with moisture. For example, the water dew point of the gas mixture made from bituminous coal in accordance with the present invention typically has a water dew point in the range of about 90° F. to about 130° F. One skilled in the art would be able to determine the dew point for a particular gas mixture without undue experimentation.

In accordance with the present invention, the cooled gas mixture is then passed through a second precipitator means to remove oil mist and particulates from the gas mixture and yield an industrial usable gas. As shown in FIG. 2, the gas mixture is fed from the heat exchanger 52 through a conduit 54 to a second electrostatic precipitator 56 to remove oil mist and particulates from the gas mixture and yield, through a conduit 58, an usable industrial gas. Maintaining a lower temperature in the second electrostatic precipitator 56 relative to the first electrostatic percipitator 38 markedly improves the removal of particulates by effecting condensation of oil in the second electrostatic precipitator 56.

Light oil and solids are removed from the second electrostatic precipitator 56 through a conduit 60. The light oil and solids can be fed to a drum 61 to be mixed with the light oil and solids 39 from the first precipitator 38 to form tar. A suitable electrostatic precipitator 56 is an oil-washed, tubular electrostatic precipitator sold by The Belco Corporation.

As a result of the present process, the resulting gas is usable in various industrial applications because it is relatively free of oil mist and particulate contamination. Therefore, the resulting clean gas can be used as industrial fuel gas.

The present method also maintains the thermal efficiency of the overall gas production facility, because the gas is delivered from the present process at temperatures of about 250° F. to about 400° F., or higher. Consequently, the present method conserves a significant amount of the heat produced from the carbonaceous feed.

Furthermore, as opposed to the cold clean gas treatment technique, the present invention does not produce an unwanted sour water composed of various organic contaminants such as phenols and pyridines. It is believed, without being bound by theory, that by cleaning the raw gas from the gas producer at a temperature above the water dew point, the present method avoids the undesirable condensation of water and pyridine water.

It will be apparent to those skilled in the art that various other modifications and variations could be made in the present invention without departing from the scope and content of the invention.

What is claimed is:

1. A method for cleaning gas produced from solid carbonaceous material in a two stage gas producer consisting essentially of the steps of:

(a) passing second stage gas from the two stage gas producer through a first precipitator means to remove oil mist and particulates from the second stage gas;

(b) passing first stage gas from the two stage gas producer through a cyclone means to remove particulates from the first stage gas;

(c) cooling the first stage gas from the cyclone means;

(d) mixing the cooled first stage gas and the second stage gas from the first precipitator means, while maintaining the temperature of the gas mixture at least at the temperature of the second stage gas;

(e) cooling the gas mixture to a temperature in the range of about 25° F. to about 125° F. above the water dew point of the gas mixture; and (f) passing the cooled gas mixture through a second precipitator means to remove oil mist and particulates from the gas mixture and yield an industrial usable gas.

2. The method of claim 1 wherein the second stage gas from the two stage gas producer has a temperature in the range of about 200° F. to about 400° F.

3. The method of claim 1 wherein the second stage gas from the two stage gas producer has a temperature in the range of about 250° F. to about 350° F.

4. The method of claim 1 wherein the first stage gas from the two stage gas producer has a temperature in the range of about 1000° F. to about 1400° F.

5. The method of claim 1 wherein the first stage gas from the two stage gas producer has a temperature in the range of about 1150° F. to about 1200° F.

6. The method of claim 1 wherein in cooling step (c) the first stage gas is cooled to a temperature sufficient so that the gas mixture in step (d) has a temperature in the range of about 200° F. to about 400° F.

7. The method of claim 1 wherein in cooling step (e) the gas mixture is cooled to a temperature in the range of about 75° F. to about 125° F. above the water dew point of the gas mixture.

8. The method of claim 1 wherein in step (e), the water dew point of the gas mixture is in the range of 90° F. to 130° F.

9. The method of claim 1 wherein the first precipitator means is an electrostatic precipitator.

10. The method of claim 1 wherein the second precipitator means is an electrostatic precipitator.

11. The method of claim 1 wherein the cyclone means is a cyclone.

12. The method of claim 1 wherein the solid carbonaceous material is coal.

13. The method of claim 1, wherein the first stage gas is cooled in a heat exchanger in step (c).

14. The method of claim 13, wherein the heat exchanger is a steam generator.

15. The method of claim 13 wherein the heat exchanger is a gas to gas heat exchanger.

16. The method of claim 13, wherein the heat exchanger heats the industrial usable gas from the second precipitator means with heat removed from the first stage gas.

17. A method for cleaning gas produced from solid carbonaceous material in a two stage gas producer consisting essentially of the steps of:

(a) passing second stage gas from the two stage gas producer at a temperature in the range of about 200° F. to about 400° F. through a first electrostatic precipitator to remove oil mist and particulates from the second stage gas;

(b) passing first stage gas from the two stage gas producer at a temperature in the range of about 1000° F. to about 1400° F. through a cyclone to remove particulates from the first stage gas;

(c) cooling the first stage gas from the cyclone;

(d) mixing the cooled first stage gas and the second stage gas from the first electrostatic precipitator, while maintaining the temperature of the gas mixture in the range of about 200° F. to about 400° F.;

(e) cooling the gas mixture to a temperature in the range of about 25° F. to about 125° F. above the water dew point of the gas mixture; and (f) passing the cooled gas mixture through a second electrostatic precipitator to remove oil mist and particulates from the gas mixture and yield an industrial usable gas.

18. The method of claim 17 wherein in cooling step step (e) the gas mixture is cooled to a temperature in the range of about 75° F. to about 125° F. above the water dew point of the gas mixture.

19. The method of claim 17 wherein the solid carbonaceous material is coal.

20. The method of claim 17 wherein the second stage gas from the two stage gas producer has a temperature in the range of about 250° F. to about 350° F.

21. The method of claim 17 wherein the first stage gas from the two stage gas producer has a temperature in the range of about 1150° F. to about 1200° F.

* * * * *